US010444660B2

(12) United States Patent
Hagiwara et al.

(10) Patent No.: US 10,444,660 B2
(45) Date of Patent: Oct. 15, 2019

(54) DEVELOPING APPARATUS WITH REGULATING MEMBER HAVING A CURVED CONTACT SURFACE AND IMAGE FORMING APPARATUS

(71) Applicant: CANON KABUSHIKI KAISHA, Tokyo (JP)

(72) Inventors: Kazunari Hagiwara, Yokohama (JP); Takaaki Shinkawa, Tokyo (JP); Koji An, Tokyo (JP); Takashi Mukai, Kawasaki (JP); Takuya Kitamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/155,940

(22) Filed: Oct. 10, 2018

(65) Prior Publication Data

US 2019/0113862 A1 Apr. 18, 2019

(30) Foreign Application Priority Data

Oct. 13, 2017 (JP) ..... 2017-199219

(51) Int. Cl.
*G03G 15/08* (2006.01)
*G03G 21/00* (2006.01)
*G03G 21/18* (2006.01)

(52) U.S. Cl.
CPC ..... *G03G 15/0812* (2013.01); *G03G 21/0011* (2013.01); *G03G 21/0017* (2013.01);
(Continued)

(58) Field of Classification Search
CPC ..... G03G 15/0812; G03G 21/1814; G03G 21/0011; G03G 21/0017; G03G 21/0029; G03G 2215/0805; G03G 2221/0089
See application file for complete search history.

(56) References Cited

U.S. PATENT DOCUMENTS 7,773,923 B2 8/2010 Hagiwara et al.
8,577,249 B2 11/2013 Adachi et al.
(Continued)

FOREIGN PATENT DOCUMENTS

EP 2 908 179 A1 8/2015
JP S62-118372 A 5/1987
(Continued)

OTHER PUBLICATIONS

Takashi Mukai, U.S. Appl. No. 16/152,486, filed Oct. 5, 2018.
European Search Report dated Feb. 5, 2019, in related European Patent Application No. 18200076.0.

*Primary Examiner* — Joseph S Wong
(74) *Attorney, Agent, or Firm* — Venable LLP

(57) ABSTRACT

A developing apparatus includes a developer carrying member, a developer container, and a regulating member to regulate the thickness of the developer. The regulating member includes a support member having one end fixed to the developer container and the other end free, with the support member extending in a direction opposite to the rotating direction of the developer carrying member, and a contact member to be fixed to the other end of the support member and to contact the developer carrying member. The contact member includes a contact curved surface along a peripheral surface of the developer carrying member, and an opposite surface to face the developer carrying member. The contact pressure of the contact curved surface applied to the developer carrying member decreases as a location on the developer carrying member approaches a downstream side in the rotating direction.

12 Claims, 10 Drawing Sheets

(52) U.S. Cl.
CPC ..... *G03G 21/0029* (2013.01); *G03G 21/1814* (2013.01); *G03G 2215/0805* (2013.01); *G03G 2221/0089* (2013.01)

(56) References Cited

U.S. PATENT DOCUMENTS

| | | | | |
|---|---|---|---|---|
| 8,948,665 | B2 | 2/2015 | Kase et al. | |
| 9,170,525 | B2 | 10/2015 | Adachi et al. | |
| 9,442,418 | B2 | 9/2016 | Kawamoto et al. | |
| 9,581,933 | B2 | 2/2017 | Kase et al. | |
| 10,078,291 | B2 | 9/2018 | Shinkawa et al. | |
| 2002/0085861 | A1* | 7/2002 | Izumi ..... | G03G 15/0812 399/274 |
| 2007/0297834 | A1 | 12/2007 | Nishida et al. | |
| 2008/0095555 | A1* | 4/2008 | Saeki ..... | G03G 15/0812 399/284 |
| 2008/0310886 | A1 | 12/2008 | Shimizu et al. | |
| 2012/0301189 | A1* | 11/2012 | Kase ..... | G03G 15/0812 399/284 |
| 2014/0334854 | A1 | 11/2014 | Kitamura et al. | |

FOREIGN PATENT DOCUMENTS

| | | | |
|---|---|---|---|
| JP | S64-057278 | A | 3/1989 |
| JP | H01-304475 | A | 12/1989 |
| JP | H11-316499 | | 11/1999 |
| JP | 2009-042320 | A | 2/2009 |
| JP | 2013-008009 | A | 1/2013 |
| JP | 2015-172737 | A | 10/2015 |

* cited by examiner

DEVELOPING APPARATUS WITH REGULATING MEMBER HAVING A CURVED CONTACT SURFACE AND IMAGE FORMING APPARATUS

BACKGROUND OF THE INVENTION

Field of the Invention

The present invention relates to an electrophotographic image forming apparatus.

Description of the Related Art

In an image forming apparatus using an electrophotographic process, such as a laser printer, a contact developing system using a developing roller having an elastic layer has been known as a developing system which uses mono-component toner as developer. Here development is performed by a developing roller (elastic roller) carrying toner and contacting the surface of a photosensitive drum. Toner is supplied to the developing roller by a supply roller which contacts the developing roller. The supply roller transports toner from the developer container and adheres the toner to the developing roller, and also has a function to remove the toner remaining on the developing roller. To regulate the toner layer adhering to the developing roller and to charge the toner layer by triboelectric charging, the toner regulating member is contacted with the developing roller. For the toner regulating member, a blade type is proposed, which is a cantilever-supported thin metal plate and of which ventral part on the opposite side of the cantilever-supported portion is contacted to the developing roller, has been proposed. The toner coated on the developing roller by the toner regulating member develops an electrostatic latent image formed on the photosensitive drum using the potential of the bias applied onto the developing roller (Japanese Patent Application Publication No. S62-118372). Further, to stabilize the toner coat layer, a configuration to contact only the edge portion at the tip of the regulating member formed of a flat elastic body, or only a surface including the edge portion (surface on the downstream side of the developing roller in the moving direction viewed from the edge portion) to the developing roller, is proposed (Japanese Patent Application Publication No. S64-57278).

SUMMARY OF THE INVENTION

In the case of using a regulating blade, which is a blade-shaped regulating member, the regulating blade is cantilever-supported, and the ventral part of the regulating blade facing the developing roller is contacting with the developing roller. Thereby a desired charge amount can be set for the developer. When such a regulating member is used, a ghost image may easily be generated. A ghost image is a phenomenon in which a hysteresis of toner images, developed in previous rotations of the developing roller, appear in subsequent rotations in a uniform halftone image as a density difference having a phase difference of the cycle of the developing roller. In other words, the generation of a ghost image means that the toner laid-on level on the coat layer or the toner charge amount is different between the state of operating several rotations without development and the state immediately after development when toner is supplied and the regulating blade is passed only once.

For example, a developing apparatus, which includes a supply roller disposed to rub against the developing roller, to supply non-magnetic mono-component developer (non-magnetic toner), is known (Japanese Patent Application Publication No. S64-57278). This type of supply roller scrapes off the residual toner on the developing roller when the toner is supplied, so that development hysteresis is not generated. As a result, if this type of developing apparatus is used, developing ghost can be prevented because of the influence of developing hysteresis is suppressed. However, in the case of using this supply roller, toner receives mechanical stress and toner deterioration accelerates. In concrete terms, the toner charge amount decreases and the unevenness of the toner surface is smoothed, which accelerates the increase of the adhering force and may generate image problems, such as generation of developing ghost.

It is an object of the present invention to provide a developing apparatus, a process cartridge, and an image forming apparatus which can stably form good images for a long time regardless the developing hysteresis.

It is provided with a view to achieving one aspect as describe above a developing apparatus, including:

a developer carrying member configured to carry a developer;

a developer container configured to rotatably support the developer carrying member and to contain the developer; and a regulating member provided on the developer container and configured to regulate a thickness of the developer carried on the developer carrying member, wherein the regulating member includes:

a support member configured such that, one end thereof is fixed to the developer container, the other end thereof is a free end and the support member extends in a direction opposite to a rotating direction of the developer carrying member from the one end; and a contact curved surface having a concave curved surface that is provided approximately along a peripheral surface of the developer carrying member, the contact member includes:

a contact curved surface having a concave curved surface that is provided approximately along a peripheral surface of the developer carrying member; and an opposite surface configured to be opposite to the surface of the developer carrying member, the opposite surface being not contacted with the surface of the developer carrying member, on an upstream side of the contact curved surface in the rotating direction of the developer carrying member, and a contact pressure of the contact curved surface applied to the surface of the developer carrying member decreases as a location on the developer carrying member approaches a downstream side in the rotating direction of the developer carrying member.

In addition, it is provided with a view to achieving one aspect as describe above a process cartridge removably attached to a main body of an image forming apparatus, including:

an image bearing member for forming an electrostatic latent image thereon; and the developing apparatus as described above, wherein the developing apparatus develops the electrostatic latent image borne on the image bearing member.

Further, it is provided with a view to achieving one aspect as describe above an image forming apparatus, including:

an image bearing member for forming an electrostatic latent image thereon; and the developing apparatus as described above, wherein the developing apparatus develops the electrostatic latent image borne on the image bearing member.

According to the present invention, good images can be stably formed for a long time regardless the developing hysteresis.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

EXAMPLE

Figure 1:
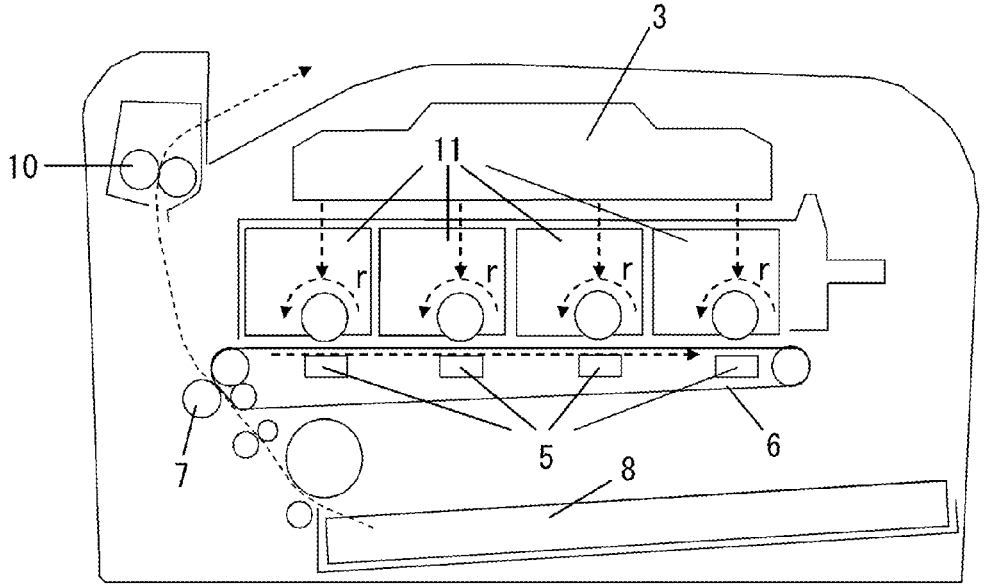
FIG. 1 is a schematic cross-sectional view of an image forming apparatus according to an example of the present invention.
Figure 2:
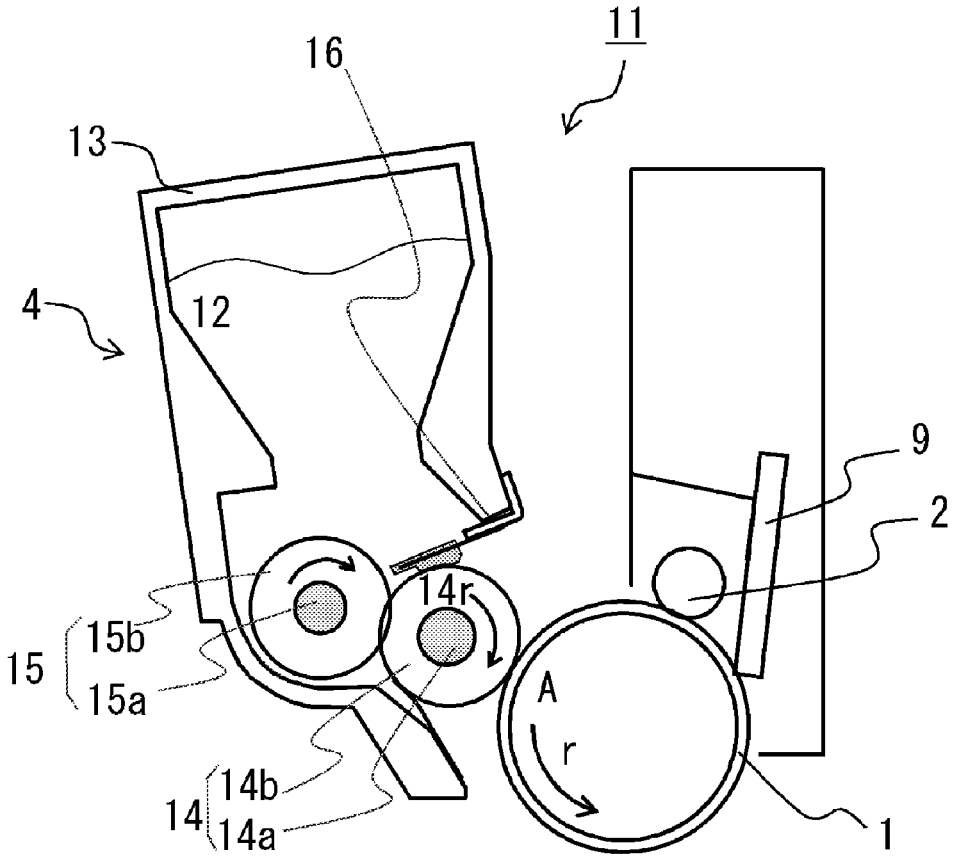
FIG. 2 is a schematic cross-sectional view of a process cartridge according to this example.

An image forming apparatus according to an example of the present invention will be described with reference to FIG. 1 and FIG. 2. FIG. 1 is a schematic cross-sectional view depicting a general configuration of the image forming apparatus according to the example of the present invention. The image forming apparatus illustrated in FIG. 1 is a full color laser printer that uses an electrophotographic process. FIG. 2 is a schematic cross-sectional view depicting a general configuration of a process cartridge according to the example of the present invention.

The image forming apparatus here refers to an apparatus that forms an image on a recording material (recording medium) by developer (toner) using the electrophotographic image forming process. Examples of the image forming apparatus are: an electrophotographic copier, an electrophotographic printer (e.g. LED printer, laser beam printer), an electrophotographic facsimile machine, an electrophotographic word processor, and a composite machine thereof (e.g. multifunction printer). The recording material is a material on which an image is formed, that is such recording material as a recording paper, an OHP sheet, a plastic sheet and cloth.

In the image forming apparatus, a photosensitive drum 1 (image bearing member) is rotated in the arrow r direction, and is charged to a uniform potential Vd by a charging roller 2 (charging apparatus). Then the photosensitive drum 1 is exposed by the laser light from a laser optical apparatus 3 (an exposing apparatus), whereby an electrostatic latent image is formed on the surface of the photosensitive drum 1. The electrostatic latent image is developed by a developing apparatus 4, and is visualized as a toner image. The visualized toner image on the photosensitive drum 1 is transferred to an intermediate transfer member 6 by a primary transfer apparatus 5, and is then transferred to paper (recording material) 8, which is a recording medium, by a secondary transfer apparatus 7. The untransferred residual toner remaining on the photosensitive drum 1 is scrapped off by a cleaning blade 9 (cleaning apparatus). The cleaned photosensitive drum 1 repeats the above operation and thereby an image is formed. Paper 8 on which the toner image is transferred, on the other hand, is fixed by a fixing apparatus 10 and is ejected outside the apparatus.

As illustrated in FIG. 2, the photosensitive drum 1, the charging roller 2, the developing apparatus 4 and the cleaning blade 9 are integrated into a processing cartridge (hereafter "cartridge") 11, which can be removably attached to the image forming apparatus main body (hereafter "apparatus main body"). The apparatus main body has four slots (not illustrated) to install the cartridges 11. The four cartridges 11, in which yellow, magenta, cyan and black toner are filled respectively, are installed in this sequence from the upstream side of the intermediate transfer member 6 in the moving direction, so that a color image is formed by sequentially transferring each color of toner to the intermediate transfer member 6. For the process cartridge, a different configuration may be used, such as a configuration in which the electrophotographic photosensitive member and at least one of the charging apparatus, the developing unit and the cleaning unit (process units, that act on the electrophotographic photosensitive member), are integrated into one cartridge. The developing apparatus 4 may be independently attachable to the apparatus main body or to the process cartridge 11. The apparatus main body here refers to a portion of the image forming apparatus after the attachable units, such as the process cartridges, are removed.

The photosensitive drum 1 is formed by laminating an organic photosensitive member on an Al cylinder (conductive base body), and this organic photosensitive member is constituted of a positive charge injection blocking layer, a charge generation layer, and a charge transport layer which are layered in this sequence. For the charge transport layer of the photosensitive drum 1, acrylate is used, and the film thickness of the charge transport layer is adjusted to 15 μm. The charge transport layer is formed by dissolving the charge transport material and a binding agent in a solvent. Examples of the organic charge transport material are acryl resin, styrene resin, polyester, polycarbonate resin, polyarylate, polysulphone, polyphenylene oxide, epoxy resin, polyurethane resin, alkyd resin and unsaturated resin. These charge transport materials may be used alone or two or more may be combined.

The charging roller 2 is constituted of a core metal (a conductive support member), and a semiconductive rubber layer which is disposed on the core metal, and the resistance of the charging roller is about $10^5\Omega$.

The developing apparatus 4 includes a toner 12 (developer), a developer container 13 (developer containing unit), a developing roller 14, a supply roller 15 which supplies toner 12 to the developing roller 14, and a regulating blade 16 (regulating member) which regulates the toner on the developing roller 14. The developing roller 14 and the supply roller 15 are rotatably supported by the developer container 13 respectively. The developing roller 14 and the supply roller 15 receive the rotating force transferred from such a power source as a motor (not illustrated), and rotate in opposite directions respectively at a contact portion where the developing roller 14 and the supply roller 15 contact with each other.

The developing roller 14 (developer carrying member) is formed by disposing a conductive rubber layer 14*b* containing a conducting agent around the core metal electrode 14*a* (conductive support member) of which outer diameter is ϕ6 (mm), and the outer diameter of the base body of the developing roller 14 is ϕ11.5 (mm). Here the possible materials of the rubber layer are silicon rubber, urethan rubber, EPDM (ethylene-propylene copolymer), hydrin rubber and mixed rubber thereof. In this example, a 2.5 mm silicon rubber and a 10 μm urethane layer are formed. For the conducting agent, a desired resistance value can be acquired by dispersing carbon particles, metal particles, ion conductive particles or the like, and in this example, carbon particles are used. To adjust the hardness of the developing roller in general, the amount of silicone rubber and the amount of silica (filler) are adjusted, whereby a developing roller having a desired hardness can be fabricated.

In the supply roller 15, a foam urethane layer 15*b* is disposed around the core metal electrode 15*a* (conductive support member) of which outer diameter is ϕ5 (mm). The outer diameter of the supply roller 15, including the foam urethane layer 15*b*, is ϕ13 (mm). The penetration amount between the supply roller 15 and the developing roller 14 is 1.2 mm. The powder pressure of the toner 12 which exists around the foam urethane layer 15*b* acts on the foam urethane layer 15*b*, and when the supply roller 15 rotates, the toner 12 enters into the foam urethane layer 15*b*. The supply roller 15 containing the toner 12 supplies the toner 12 to the developing roller 14 at the contact portion with the developing roller 14, and also provides preliminary triboelectric charges to the toner 12 by rubbing. The supply roller 15, which supplies toner to the developing roller 14, also plays a role of scrapping off the toner remaining on the developing roller 14 without being developed by the developing unit.

The toner 12 supplied from the supply roller 15 to the developing roller 14 reaches a position where the regulating blade 16 contacts the developing roller 14, and is adjusted to a desired charge amount and toner layer thickness. The regulating blade 16 is an SUS blade having a 80 μm thickness, and is disposed in a direction that is opposite the rotation direction of the developing roller 14 (counter direction). This regulating blade 16 regulates the toner 12 on the developing roller 14 to have a uniform toner layer thickness, and a desired charge amount is acquired by the triboelectric charging generated by rubbing. Further, voltage is applied to the regulating blade 16 by the power supplied from a power supply (not illustrated), so as to have a −200 V potential difference from the developing roller 14. This potential difference is to stabilize the toner coat layer.

The toner layer, which is formed on the developing roller 14 by the regulating blade 16, is transported to the developing unit which contacts the photosensitive drum 1, and reversal development is performed in the developing unit. In the contact position A, the penetration amount of the developing roller 14 into the photosensitive drum 1 is set to 40 μm by the roller (not illustrated) at the edge of the developing roller 14. The surface of the developing roller 14 is deformed by being pressed against the photosensitive drum, whereby the developing nip portion is formed, and development can be performed in a stable contacting state. At the developing nip portion formed with the photosensitive drum 1, the developing roller 14 rotates at a 160% peripheral speed ratio with respect to the photosensitive drum 1. Setting this peripheral speed difference stabilizes the toner amount used for development.

Specific voltage settings in this example will be described. The surface of the photosensitive drum 1 is uniformly charged at −500 V by applying −1050 V to the charging roller 2, so as to generate the dark potential (Vd), and the printing portion is adjusted to −100 V (light potential Vl) by laser (exposing means). If a −300 V voltage (Vdc) is applied to the developing roller 14 at this time, the reversal phenomena, in which toner having negative polarity changes to light potential, is generated. |Vd−Vdc| is called "Vback", and the Vback here is 200 V.

The toner 12 is a non-magnetic mono-component toner, and is adjusted to contain a bonding resin and a charge control agent, and has negative polarity which is generated by adding a fluidizer or the like as an external additive. The toner 12 is created by the polymerization method, and the average particle diameter is adjusted to about 6 μm.

EXAMPLE AND COMPARATIVE EXAMPLE

Example

Figure 3A:
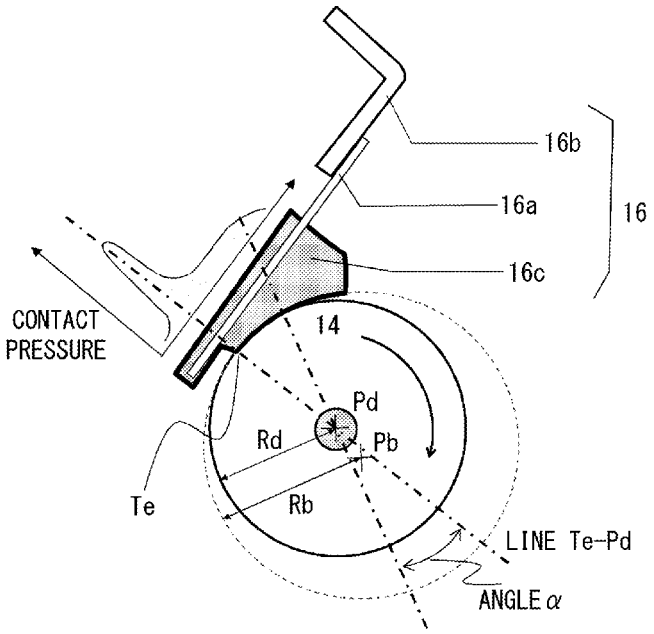
FIGS. 3A to 3C are schematic cross-sectional views to describe a regulating blade according to this example.
Figure 3B:
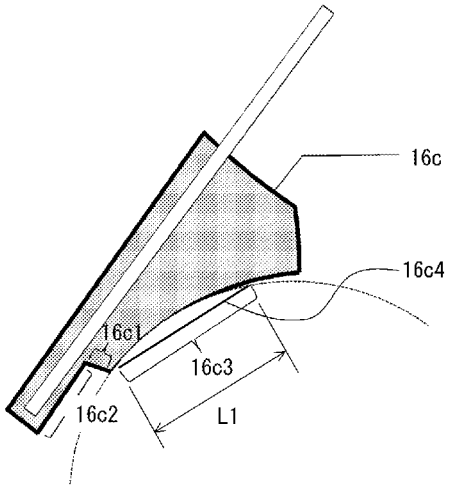
Figure 3C:
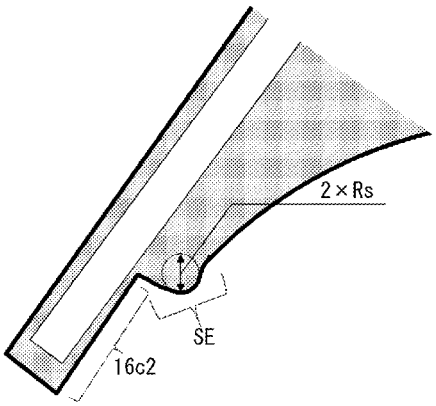
Figure 4:
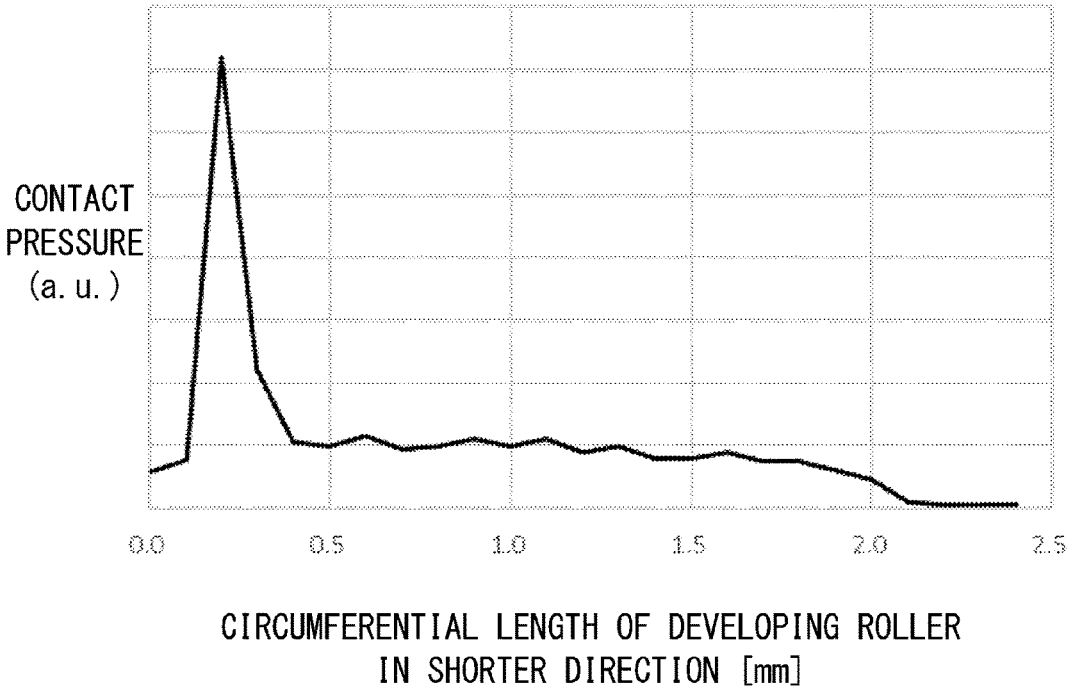
FIG. 4 is a graph depicting the contact pressure distribution formed by the regulating blade according to this example.

The regulating blade 16 according to an example of the present invention will be described with reference to FIGS. 3A to 3C to FIGS. 5A to 5D. FIG. 3A is a schematic cross-sectional view depicting the regulating blade 16 according to this example and a peripheral configuration thereof. FIG. 3B if a schematic cross-sectional view depicting the configuration of the regulating blade 16 according to this example. FIG. 3C is a schematic cross-sectional view depicting the tip portion of the regulating blade 16 according to this example. FIG. 4 is a graph depicting the contact pressure distribution formed by the regulating blade according to this example.

As illustrated in FIGS. 3A to 3C, the regulating blade 16 according to this example includes a plate type elastic member 16*a*, a support member 16*b* which supports the elastic member 16*a*, and a contact member 16*c* which is disposed at the tip of the elastic member 16*a* and which has flexibility. The elastic member 16*a* has a cantilever structure, where one end thereof is fixed to the support member 16*b*, which is fixed to the developer container (developing frame 13) and extends from this fixed end in the direction opposite to the rotating direction of the developing roller 14, and the other end thereof is a free end. The elastic member 16*a* contacts the developing roller 14 via the flexible contact member 16*c* at the tip on the free end side, which is the opposite side of the end supported by the support member 16*b*. The contact member 16*c* has an opposite surface 16*c*2, a step surface 16*c*1, and a contact curved surface 16*c*3 in order from the upstream side to the downstream side in the rotating direction of the developing roller 14, in the cross-section viewed in the rotation axis direction of the developing roller 14. The opposite surface 16*c*2 faces the surface of the developing roller 14 with a predetermined space there between (so as to not contact the surface of the developing roller 14) on the upstream side of the step surface 16*c*1 in the rotating direction of the developing roller 14. The contact curved surface 16*c*3 has a concave curved surface, which is provided approximately along the surface (peripheral surface) of the developing roller 14, so as to contact the surface of the developing roller 14 on the downstream side of the step surface 16*c*1 in the rotating direction of the developing roller 14. When the developing roller 14 is viewed in the rotation axis direction, the height (thickness) of the contact member 16*c* from the support member 16*b* is set so that the height (thickness) from the surface of the support member 16*b* to the contact curved surface 16*c*3 is greater (thicker) than the height (thickness) of the opposite surface 16*c*2 from the surface of the support member 16*b*. This height (thickness) of the contact curved surface 16*c*3 becomes greater (thicker) as the downstream side is approached in the rotating direction of the developing roller 14. In this configuration, the regulating blade 16 is pressed against the developing roller 14 by pushing the regulating blade 16 to the developing roller 14 for a predetermined amount in the state where the elastic member 16*a*, the contact member 16*c* and the developing roller 14 are in contact with no load. The regulating blade 16 is disposed at the contact position of the developing roller 14 and the regulating blade 16, so that the tip of the elastic member 16*a* on the free end side contacts the developing roller 14 in the state of facing the upstream side in the moving direction of the developing roller 14 (counter direction).

For the elastic member 16*a*, a plate member made of a material having elasticity (spring characteristic), such as a thin metal plate of stainless steel, phosphor bronze, aluminum alloy or the like, or a thin plate made of a high hardness conductive resin can be used.

For the support member 16*b*, a plate member, such as a metal plate, that is thicker than the elastic member 16*a* can be used. In this example, the elastic member 16*a*, made of a stainless steel plate (0.08 mm thickness) is fixed to the support member 16*b* which is formed by bending an iron plate (1.2 mm thickness) to an L-shaped cross-section. That is, the support member is an elastic member, which has an elasticity higher than an elasticity of a frame member of the developer container.

The materials that can be used for the contact member 16*c* are silicon resin, urethane resin, acrylic resin and epoxy resin. Such metal as stainless steel, phosphor bronze and aluminum alloy can also be used. In this example, acrylic resin is used. The contact member 16*c* may contain a conductive agent to adjust the electric resistance. The conductive agent can be metal oxide, carbon black or the like. In this example, carbon black is used as the conductive agent. The contact member 16*c* can be manufactured while adjusting the shape using extrusion molding or metal molding. In this example, a desired shape is created by metal molding. If the material of the contact member 16*c* is metal, as mentioned above, the desired shape may be formed by carving. That is, the contact member is a flexible member, which has a flexibility higher than a flexibility of the support member.

Step Surface, Opposite Surface and Contact Curved Surface

As illustrated in FIG. 3B, the tip of the regulating blade 16 is constituted of the step surface 16*c*1, and the opposite surface 16*c*2 which is disposed on the upstream side in the rotating direction of the developing roller, maintaining a predetermined space from the surface of the developing roller, so as to form a gap (eave portion) between the tip of the regulating blade 16 and the developing roller 14. In this example, the height of the step surface is 200 μm, and that of the opposite surface 16*c*2 (length in the shorter direction) is 1500 μm.

The function of the step surface 16*c*1 and the opposite surface 16*c*2 of this example will be described. The toner 12 supplied to the developing roller 14 remains in the eave portion if the toner 12 cannot pass the contact portion between the regulating blade 16 and the developing roller 14 and is regulated. The remaining toner 12 flows in the direction opposite from that of the toner on the outermost surface of the developing roller 14, hence the replacement performance of the toner improves. In addition, in the case of toner deterioration or toner having high charging performance, the adhering force between the developing roller 14 and the toner is high, therefore high regulating force is required at the inlet of the contact portion. In order to acquire high regulating force without setting an excessively high contact pressure, a predetermined contact pressure must be set at the inlet of the contact portion, as illustrated in FIGS. 3A to 3C. Thereby toner which does not pass the inlet of the contact portion and which remains in the eave portion can be stably generated, and the replacement performance can be maintained. In other words, in this example, a simple configuration having the step surface 16*c*1 and the opposite surface 16*c*2 is used as a configuration for stably implementing a high regulation force and replacement performance by setting desired contact pressure at the inlet and functionally separating the eave space.

Further, in this example, the contact curved surface 16*c*3 is formed along the developing roller 14 so as to contact the developing roller 14, and this prevents a drop in toner charging performance by increasing the triboelectric charging chances in this contact portion with the developing roller 14. Furthermore, in order to decrease excessive stress to the toner, it is preferable that the contact pressure of the contact curved surface 16*c*3 applied to the surface of the developing roller 14 decreases as the location on the developing roller 14 approaches a downstream side in the rotating direction of the developing roller 14. To provide sufficient charging chances, the width of the contact portion (contact portion between the regulating blade 16 (contact curved surface 16*c*3) and the developing roller 14) in the shorter direction is preferably 1000 μm or more (1.0 mm or more), and ideally 1500 μm or more. In Comparative Example 1 (prior art), the width of the contact portion in the shorter direction is about 500 μm. This means that in the case of this example, which has the above mentioned width, charging chances can be provided by one passing of the regulating blade that are equivalent to at least passing the regulating blade 2 or 3 times if Comparative Example 1 is used. The width of the contacting portion in the shorter direction is a length L1 of a virtual straight line 16*c*4 connecting one end of the contact portion (one side of the border line between the contact portion and the non-contact point) and the other end of the contact portion (the other side of the border line between the contact portion and the non-contact portion).

Contact Pressure Measurement

FIG. 4 is a graph generated by plotting the result of measuring the contact pressure between the developing roller 14 and the regulating blade 16 described above, using a tactile sensor made by Nitta Corp. The abscissa indicates the circumferential length of the developing roller 14 in the shorter direction with the inlet of the contact portion as 0. According to the measurement of the contact pressure distribution of this example, maximum of the contact pressure appears at the upstream side edge of the developing roller 14 in the rotation direction in the region where the contact curved surface 16*c*3 and the developing roller 14 contact, and the contact pressure decreases as the position approaches the downstream side.

Contact Surface Forming Method

To generate the above mentioned contact pressure distribution, the virtual penetration amount of the regulating blade 16 to the developing roller 14 is decreased as the position approaches the downstream side, whereby stable contact can be implemented. In this example, the virtual penetration amount is set to 1.2 mm at the most upstream side position of the contact portion, and is set to gradually decrease as the position approaches the downstream side in the developing roller rotating direction. Here the virtual penetration amount refers to a virtual superimposed amount when the developing roller 14, in a non-load state when the regulating blade 16 is not installed, is virtually superimposed on the regulating blade 16 in a non-load state when the developing roller 14 is not installed.

To stabilize contact in this example, it is preferable that the radius of curvature Rb (mm) of the arc formed by the contact portion (contact curved surface 16*c*3) of the regulating blade 16 is larger than the radius Rd (mm) of the peripheral surface of the developing roller 14 (Rb>Rd). Thereby the desired contact pressure as indicated in FIG. 4 can be acquired. In this example, the radius Rd of the developing roller 14 is 5.75 mm, and the radius of curvature Rb of the contact curved surface 16*c*3 of the regulating blade 16 is 7.5 mm. In this example, the contact curved surface 16*c*3 is an arc in which the radius of curvature Rb is constant (an arc that can overlap with the virtual true circle of which radius is Rb), but the configuration of the contact curved surface 16*c*3 is not limited to this. For example, the contact curved surface 16*c*3 may be configured by an arc of which radius of curvature changes, that is, an arc having a part of which radius of curvature is Rb (an arc that can overlap with an ellipse having a part of which radius of curvature is Rb). Further, the contact curved surface 16*c*3 may be configured by a curved line which partially has a region that can overlap with the virtual true circle of which radius is Rb. In other words, the shape of the contact curved surface 16*c*3 is not limited to the shape of this example, but may be various shapes as long as the same effect as the effect caused by the contact curved surface 16*c*3, described in this example, can be implemented.

The width of the contact portion between the regulating blade 16 and the developing roller 14 in the shorter direction and the radius of curvature Rb of the contact curved surface 16*c*3 of the regulating blade 16 are measured as follows. First the regulating blade 16, from which the toner 12 is removed, is installed in the developing apparatus 4. In this state, the shape of the contact portion is measured using a laser displacement meter (VK-X200 made by Keyence Corp.). Then the developing roller 14, on which toner is coated, is installed, and the developing roller 14 is rotated several times. Then the developing roller 14 is removed and the contact position is measured from the toner adhering portion on the surface of the regulating blade 16. Comparing with the contact portion which was measured in advance and this actual toner adhering portion, three points: (the inlet and outlet of the contact portion and the center position thereof) are calculated, and a circle passing through the three points is determined whereby the radius of curvature Rb and the center position Pb are calculated. In this example, the width of the contact portion in the shorter direction is 2000 μm.

Figure 5A:
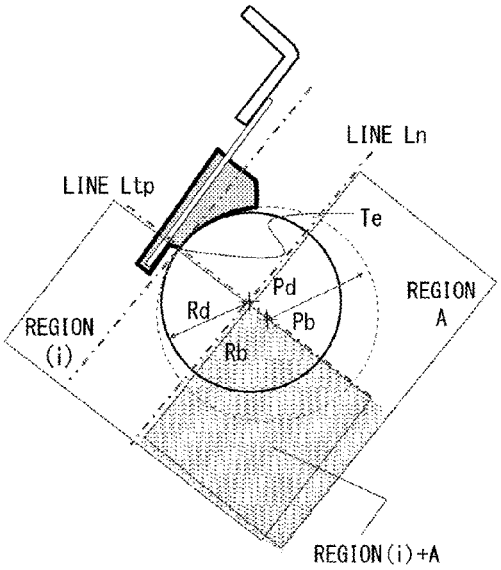
FIGS. 5A to 5D are schematic cross-sectional views to describe the regulating blade according to this example.
Figure 5B:
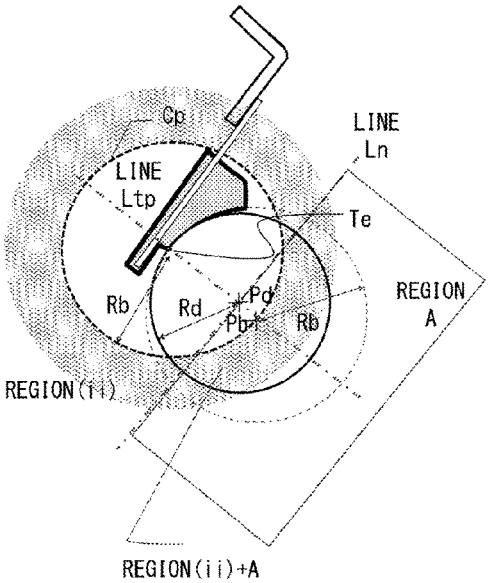
Figure 5C:
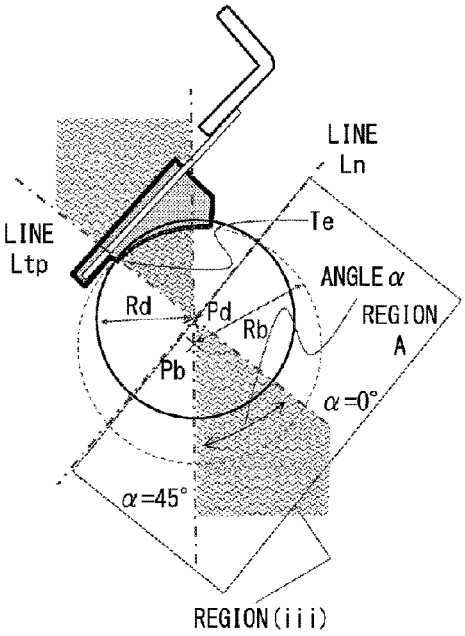
Figure 5D:
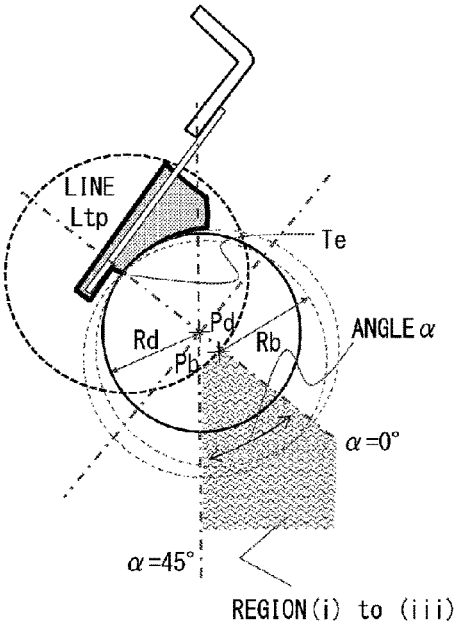

FIGS. 5A to 5D are schematic cross-sectional views depicting the positional relationships between the regulating blade 16 and the developing roller 14 according to this example. After earnest study, the inventors of the present invention discovered that the following configuration is preferable for the contact curved surface 16*c*3 to stably form the contact portion. That is, as illustrated in FIG. 5D, when Te is a point located at the most upstream position of the contact portion (contact curved surface 16*c*3), Rb is the diameter of the developing roller, Pd is the center thereof, and the center Pb of the virtual circle passing through the contact curved surface 16*c*3 exists in all regions (i) to (iii).

Region (i): a region including a virtual straight line Ltp and an area located at the upstream side of the virtual straight line Ltp in the rotating direction of the developing roller 14, and the virtual straight line Ltp is a boundary line which passes through the center Pd of the developing roller 14 and the point Te Region (ii): a region including a virtual circle Cp, and an area outside the virtual circle Cp, and the virtual circle Cp is such a boundary circle that the center thereof is the point Te and the radius thereof is the radius Rb of the contact curved surface 16*c*3

Region (iii): a region including such a virtual straight line that passes through the center Pd of the developing roller 14 and forms an angle with the virtual straight line Ltp, and the angle falls in 0° and 45°

Each region will be described. First, region A indicated in FIG. 5A will be described. Region A is a region which not does not include the virtual straight line Ln and the most upstream position Te of the contact portion, when the virtual straight line Ln is a boundary line which is parallel with the tangential line of the developing roller 14 passing through the most upstream position Te of the contact portion, and which passes through the center Pd of the developing roller 14. If Pb exists in region A, this means that the contact curved surface 16*c*3 satisfies the contact condition by compressing the developing roller 14. Region (i) is a region that is on the virtual straight line Ltp, and on the upstream side of the virtual straight line Ltp in the rotating direction of the developing roller when the virtual straight line Ltp is the boundary line. If Pb exists in region A and in region (i), this means that the contact curved surface 16*c*3 satisfies the contact condition on the downstream side in the rotating direction of the developing roller 14.

Region (ii) is a region that is on the circumference of the virtual circle Cp and outside the virtual circle Cp when the virtual circle Cp is a boundary circle of which center is the point Te and radius is the radius Rb of the contact curved surface 16*c*3, as illustrated in FIG. 5B. The virtual circle Cp is a locus of the center of the virtual circle, which has the radius Rb and passes through the most upstream position Te of the contact portion and another point on the developing roller other than the point Te. In other words, if Pb exists on the circumference of the virtual circle Cp, this means that the contact curved surface 16*c*3 satisfies the contact condition at two points (including point Te) on the circumference of the developing roller 14. Further, if Pb exists in the overlapping region outside the circumference of the virtual circle Cp and region A, this means that the contact curved surface 16*c*3 satisfies the contact condition by compressing the developing roller 14.

Finally region (iii), illustrated in FIG. 5C, will be described. Region (iii) is a region on a virtual straight line which passes through the center Pb of the developing roller 14, and of which angle formed with the virtual straight line Ltp is 0° to 45°. This is a case when the center Pb of the contact curved surface 16*c*3 is located on the virtual straight line of which angle formed with the virtual straight line Ltp is α=45° taking region A into consideration. Here the contact curved surface 16c3 passes through and the intersecting point of the virtual straight line Ln and the developing roller 14, and the point Te, whereby the contact stability can be implemented.

As described above, in order to implement contact stability, the center Pb of the contact curved surface 16c3 must exist in region A and in regions (i) to (iii). However it is sufficient if the center Pb exists in regions (i) to (iii), as illustrated in FIG. 5D, since Region A is included in regions (1) to (iii).

In this example, the contact stability can be implemented when the center Pb exists on the virtual straight line, of which angle α formed with the virtual straight line Ltp is 0° to 45°. If α exceeds 45°, the penetration amount in contact is too large, which accelerates toner deterioration. Therefore taking the contact stability into consideration, it is preferable that the center Pb of the contact curved surface 16c3 exists on the virtual straight line, of which angle α formed with the virtual straight line Ltp is at least 0° and not more than 45°. To implement further contact stability, it is more preferable that the angle α is at least 5° and not more than 30°.

The curved surface (arc surface) SE, which continuously connects the step portion 16c1 and the contact curved surface 16c3, will be described with reference to FIG. 3C. The radius of curvature Rs of the curved surface SE is preferably at least 0.01 mm and not more than 1.0 mm, in order to provide the desired contact pressure at the tip of the contact curved surface 16c3, and stably generate a lighter contact pressure downstream side thereof. It is even better if the radius of curvature Rs is at least 0.05 mm and not more than 1.0 mm. If the radius of curvature Rs is less than 0.01 mm, the peak width of the contact pressure distribution at the inlet of contact portion becomes small, which easily causes contact unevenness in the longer direction, and if the radius of curvature Rs exceeds 1.0 mm, the contact pressure at the inlet of contact portion decreases, and a sufficient regulating force cannot be acquired.

Comparative Example 1

Figure 10:
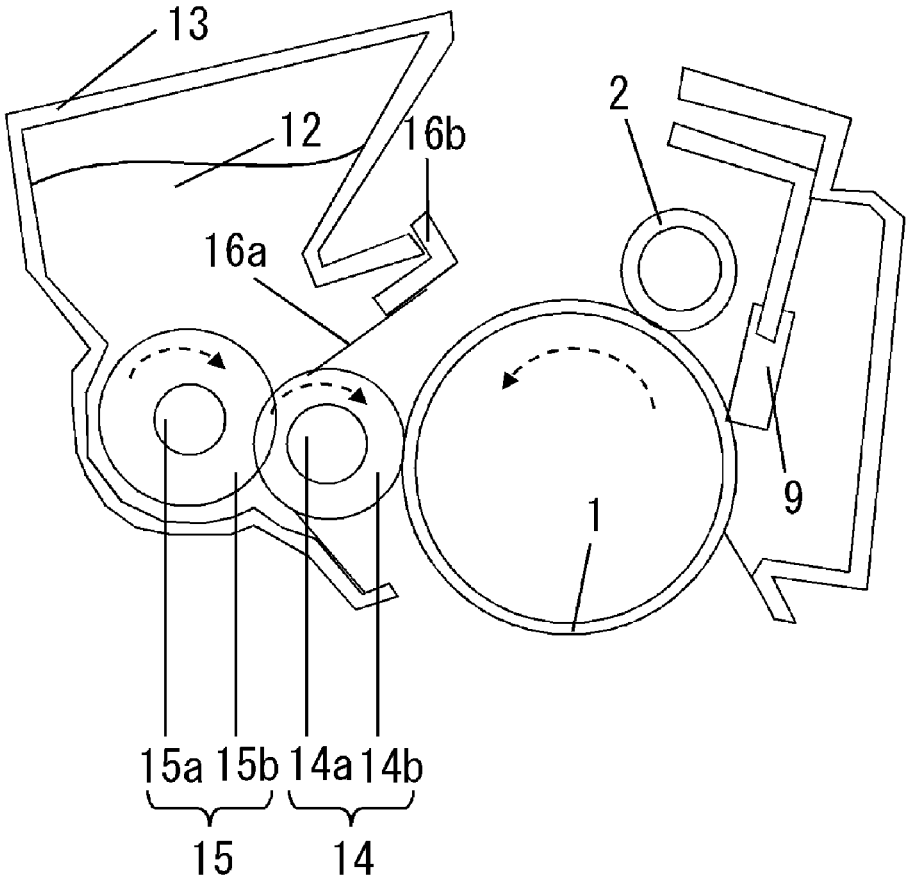
FIG. 10 is a schematic diagram depicting a process cartridge according to Comparative Example 1.

FIG. 10 is a schematic cross-sectional view depicting a configuration of a toner regulating member according to Comparative Example 1 (prior art). A developing blade (toner regulating member) is configured such that a thin plate elastic member 16a (e.g. phosphor bronze plate, stainless plate) is cantilever-supported by a support metal plate which is fixed to a developer container 13, and the free end side of the thin plate elastic member 16a is in contact with a developing roller 14. In Comparative Example 1, the stainless plate is used for the thin plate elastic member, and the tip of the free end of the thin plate elastic member is in contact with the surface of the developing roller 14, as illustrated in FIG. 10.

Comparative Example 2 (Configuration Disclosed in Japanese Patent Application Publication No. H01-304475)

Figure 6:
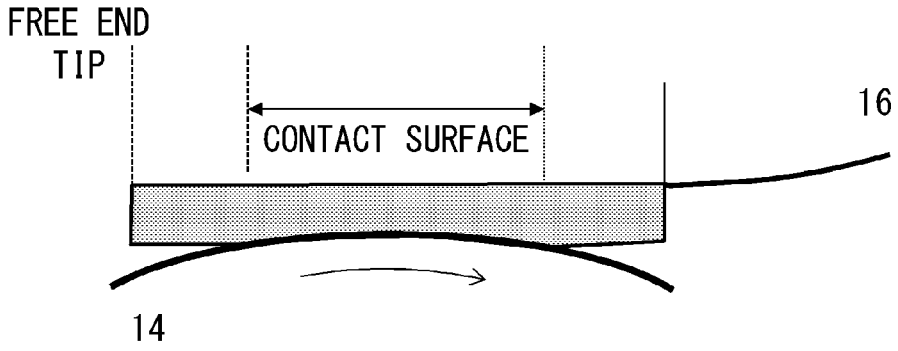
FIG. 6 is a schematic diagram to describe the regulating blade according to Comparative Example 2.

FIG. 6 is a schematic cross-sectional view depicting a configuration of a toner regulating member according to Comparative Example 2. Comparative Example 2 is basically the same as Comparative Example 1, except for the condition of contacting the developing roller. In concrete terms, as illustrated in FIG. 6, the tip of the free end of the toner regulating member 16 (thin plate elastic member) has a space from the surface of the developing roller 14. Further, the setting for the tip of the toner regulating member 16 contacting the surface of the developing roller 14 is such that the contacting width thereof becomes 1500 μm.

Comparative Example 3 (Configuration Disclosed in Japanese Patent Application Publication No. 2015-172737)

Figure 7:
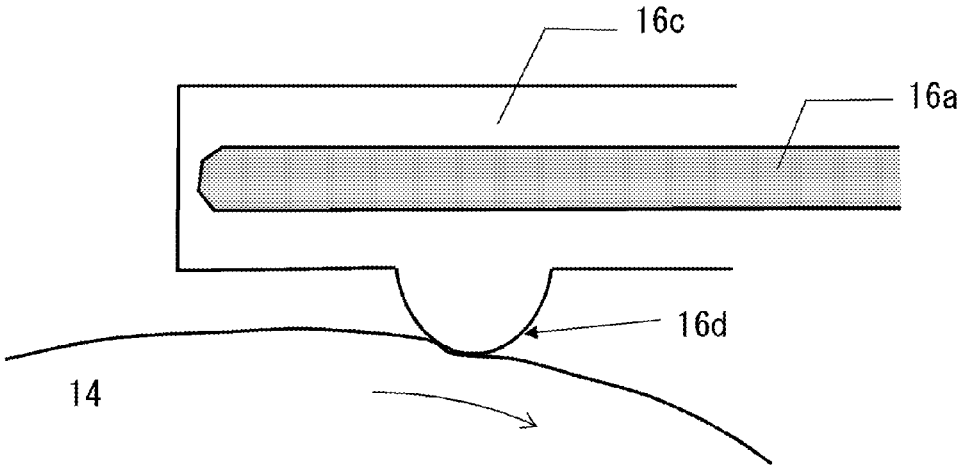
FIG. 7 is a schematic diagram to describe the regulating blade according to Comparative Example 3.

FIG. 7 is a schematic cross-sectional view depicting a configuration of a toner regulating member according to Comparative Example 3. Comparative Example 3 is basically the same as Comparative Example 1 except for the following aspect. That is, as illustrated in FIG. 7, a projection 16d is formed in the contact portion, and the toner is regulated by this projection 16d contacting the developing roller 14.

Comparative Example 4 (Configuration Disclosed in Japanese Patent Application Publication No. 2013-8009)

Figure 8:
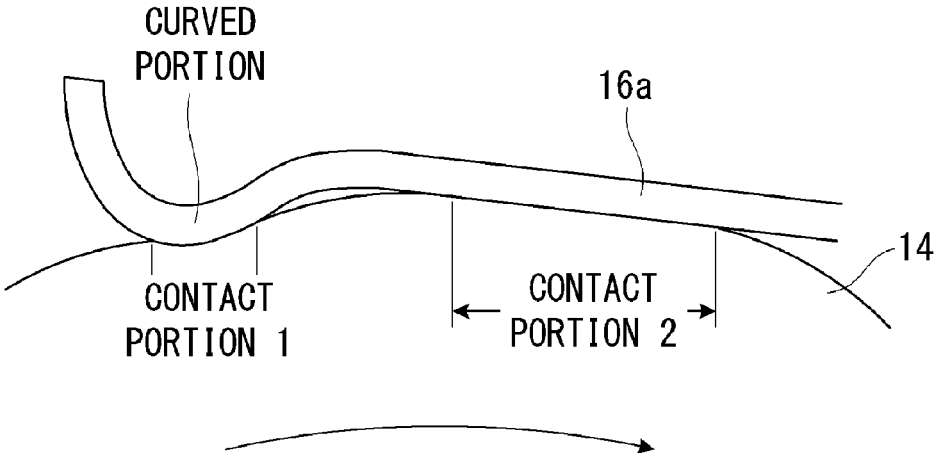
FIG. 8 is a schematic diagram to describe the regulating blade according to Comparative Example 4.

FIG. 8 is a schematic cross-sectional view depicting a configuration of a toner regulating member according to Comparative Example 4. Comparative Example 4 is basically the same as Comparative Example 1 except for the following aspect. That is, as illustrated in FIG. 8, the tip of the free end of the thin plate elastic member 16a has a curved portion. The tip of the free end contacts the developing roller 14 at a contact portion 1 at this curved portion and a contact portion 2 on the downstream side thereof in the rotating direction of the developing roller.

Comparative Example 5 (Configuration Disclosed in Japanese Patent Application Publication No. H11-316499)

Figure 9:
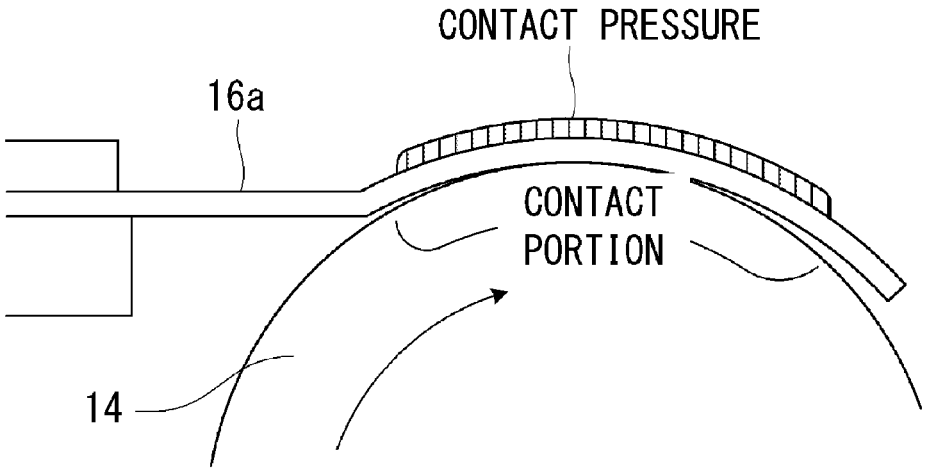
FIG. 9 is a schematic diagram to describe the regulating blade according to Comparative Example 5.

FIG. 9 is a schematic cross-sectional view depicting a configuration of a toner regulating member according to Comparative Example 5. A developing blade (toner regulating blade) is configured such that a thin plate elastic member 16a (e.g. phosphor bronze plate, stainless plate) is cantilever-supported by a support metal plate which is fixed to a developer container. The tip on the free end side of the thin plate elastic member has a shape along the peripheral surface of a developing roller 14, and contacts the developing roller 14. The contact portion with the developing roller 14 is a forward contact, that is, the free end of the regulating blade is directed to the downstream side in the rotating direction of the developing roller.

Evaluation Method

An evaluation method according to this example will be described. Each evaluation is performed using the laser printer MF726 Cdw (made by Canon).

Fogging Evaluation in High Humidity Environment

Fogging is an image defect that appears in a white portion (unexposed portion) which should not be a printed portion, and looks slightly stained by a small amount of toner that is developed. The fogging amount is evaluated as follows.

The image forming apparatus is stopped while printing a solid white image. After development and before transfer, the toner on the photosensitive drum is transferred to a transparent tape, and the tape on which the toner adheres is attached to a recording paper or the like. Further, a tape on which toner does not adhere is also attached to the same recording paper. From above the tapes attached to the recording paper, each optical reflectance is measured by an optical reflectance meter (TC-6DS made by Tokyo Denshoku Co., Ltd.) using a green filter. Then the reflectance of a tape on which toner adheres is subtracted from the reflectance of the tape on which toner does not adhere, whereby the reflectance change caused by the fogging is determined and evaluated as the fogging amount. For the fogging amount, the measurement is performed for at least three points on the tapes, and a mean value thereof is determined.

A: fogging amount is less than 1.0%

B: fogging amount is at least 1.0 and less than 3.0%

C: fogging amount is at least 3.0 and less than 5.0%

D: fogging amount is at least 5.0%

The fogging evaluation is performed after printing 2,000 pages in a test environment (30° C., 80% RH), then leaving the printed paper for 24 hours. The printing test is performed by continuously feeding an image of horizontal lines (image ratio: 5%). To generate the horizontal lines at the 5% image ratio, printing one dot line then not printing for 19 dot lines are repeated.

Edge Coating Defect Evaluation in Low Temperature, Low Humidity Environment

Toner which easily aggregates due to deterioration cannot be regulated smoothly by the regulating blade, which increases the laid-on level of the toner coat layer (particularly on the edges). This results in edge coating defects.

To evaluate the uniformity of the toner coat layer in the longer direction, a half tone image and a solid white image are evaluated. Immediately after printing 2,000 pages in the 15.0° C. and 10% RH environment, a solid white image and a half tone image are continuously fed. The printing test is performed by continuously feeding an image of horizontal lines (image ratio: 5%). The evaluation is performed based on the following standard.

A: vertical strips of density non-uniformity are not recognized on both edges of the solid white image and the half tone image B: vertical strips of density non-uniformity are recognized on both edges of the half tone image C: vertical strips of density non-uniformity are recognized on both edges of the solid white image In this evaluation, the half tone image is generated by repeating the recording of one line in the main scanning direction and the non-recording of four lines thereafter, that is, the half tone density is expressed by microscopic stripes.

Developing Ghost Evaluation

The supply of developer to the developing roller and the scraping thereof are evaluated by a developing ghost image. Considering the peripheral speed of the developing roller and the process speed, the developing ghost image that appears at the rotating cycle of the developing roller is evaluated. In concrete terms, solid black patch images (5 $mm^2$ and 25 $mm^2$) are printed at the front end of the transfer material P, and is visually checked in the subsequent uniform half tome image whether a density difference appears in the patch images at the rotating cycle of the developing roller. If the density difference is visually recognized, it is determined that an image defect is generated due to a developing ghost. In this evaluation, the half tone image is generated by repeating the recording of one line in the main scanning direction and the non-recording of four lines thereafter, that is, the half tone density is expressed by microscopic stripes. Here the image evaluation is performed based on the following standards.

A: no density difference is recognized in either patch

B: a density difference is recognized in one patch only in the first cycle of the developing roller in the half tone image (In Table 1, B/N indicates that the patch portion is light, and B/P indicates that the patch portion is dark.)

C: a density difference is recognized in both patches in the half tone image, even after the first cycle of the developing roller The evaluation is performed immediately after 2,000 pages of the printing test. The printing test is performed by continuously printing the printing images of horizontal lines (image ratio (print ratio): 5%).

Table 1 indicates each evaluation result.

TABLE 1

| | FOGGING | EDGE COATING DEFECT | GHOST AFTER DURABILITY TEST |
|---|---|---|---|
| EXAMPLE 1 | A | A | A |
| COMPARATIVE EXAMPLE 1 | B | A | B/P |
| COMPARATIVE EXAMPLE 2 | A | C | C |
| COMPARATIVE EXAMPLE 3 | C | A | B/N |
| COMPARATIVE EXAMPLE 4 | A | C | C |
| COMPARATIVE EXAMPLE 5 | A | C | C |

Advantages of this Invention Over Comparative Techniques

Comparative Example 1 is an example when the tip of the regulating blade is contacted with the developing roller, so as to increase the regulating force of the blade. Toner deterioration after the durability test is mainly because the toner charging performance decreases, and the adhering force of the toner increases due to the toner filling the bumps of the inorganic particles formed on the surface. In Comparative Example 1, an edge coating defect is not generated, even if the adhering force of the toner increases after the durability test. This is probably because the blade regulating force is high. However, even if the toner regulating force is high, a developing ghost (positive ghost) is generated after the durability test. This reason why the positive ghost is generated will be described. Considering the charge amount required to fill the latent image of the half tone image, the toner transfer amount increases as the toner charge amount becomes lower, and the toner transfer amount decreases as the toner charge amount becomes higher. After printing the patches, toner has already passed through the regulating blade only once after being supplied to the developing roller, hence the charge amount of the toner on the developing roller is low. If the patches are not printed, the toner on the developing roller is not developed by the developing unit, and remains thereon, and toner has already passed through the regulating blade a plurality of times, hence the charge amount is high. The toner charge amount on the developing roller is low after printing the patches, and the toner transfer amount is high, hence compared with the non-printing portion, the half tone image density is darker, which is identified as a positive ghost. Furthermore, if the amount of small particle diameter toner is high in the toner coat layer after non-printing, the charge amount of small diameter toner tends to become high, hence a positive ghost is manifested even more so. In Comparative Example 1, the regulating force is high, hence large diameter toner is more easily regulated than the small diameter toner, and the ratio of the small diameter toner increases in the toner coat layer. This may be a reason why a positive ghost is generated.

Comparative Example 3 is an example when the step surface and the opposite surface are disposed, so that in addition to the regulating force at the inlet of the contact portion, the replacement performance of the toner is improved by the powder pressure of toner on the opposite surface. Therefore a developing ghost (negative ghost) is generated after the durability test, although an edge regulating defect can be prevented. The cause of generating a negative ghost will be described. When the charge amount of the toner is very small, developing efficiency drops, and the toner transfer amount decreases. After printing the patches, the half tone image density decreases because the charge amount of the toner is small and the developing efficiency decreases. This may be a reason why a negative ghost is generated. Furthermore, after the durability test, charging performance drops due to the deterioration of toner, which worsens negative ghost generation. In the case of Comparative Example 3, the toner charge amount is low because the width of the contact portion is small. In addition, as a result of enhancing the replacement performance of the toner, the toner charge amount before passing of the regulating blade tends to be small, and a sufficient charge cannot be provided to the toner merely by passing the regulating blade once. This also worsens negative ghost generation. The drop in toner charging performance is also indicated in the increase of fogging under a high temperature high humidity environment. In both Comparative Examples 1 and 3, the contact portions are small, hence the charge providing performance to the toner is low and fogging is high, but the fogging in Comparative Example 3 is even higher than Comparative Example 1. This is probably because the replacement performance of toner is enhanced in Comparative Example 3, as mentioned above, which drops the charge providing performance considerably.

In Example 1, on the other hand, a good image can be acquired without any fogging, an edge coating defect, and ghost generation after the durability test. This is because Example 1 has a step surface and opposite surface just like Comparative Example 3, whereby the replacement performance of the toner can be enhanced, and the width of the contact portion can be ensured to increase the toner adhering chances. Thereby charges can be provided even to toner after the durability test. Further, the contact pressure required to regulate toner is applied to the upstream side of the contact portion, and the pressure to downstream side thereof is light. Hence excessive toner deterioration is prevented, and a good image can be stably formed for a long time.

Comparative Examples 2, 4 and 5 are examples when the charge providing performance to toner after the durability test is improved by setting the respective contact portion large. Thereby an increase in the fogging amount under a high humidity environment is prevented. However, edge coating defects and ghosts after the durability test increase considerably. This is because toner deterioration in the contact portion accelerates, and the adhering force of the toner increases. As a result, the toner replacement efficiency drops considerably due to the aggregation between toner particles and the increase in the adhering force to the developing roller. This results in a worsening of edge coating defects and ghosts after the durability test. In Comparative Example 2, there is no clear difference between the opposite portion and the step portion, hence the replacement performance in the opposite portion and the regulating force at the inlet of the contact portion are weak, which is probably also a cause of the worsening of image defects. In the case of Comparative Example 4, the forming of an eave portion by the opposite portion is insufficient, which makes the replacement performance insufficient. In the case of Comparative Example 5, the regulating force is weak because the contact pressure at the inlet of the contact portion is small. As a result, the edge coat defect and ghost after the durability test worsen.

As described above, according to this example, the replacement performance can be enhanced by implementing a high regulating force and storing toner within the eave portion, also the toner charging performance can be ensured by using a simple configuration of the regulating blade. As a result, a good image can be stably formed for a long time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-199219, filed on Oct. 13, 2017, which is hereby incorporated by reference herein in its entirety.

What is claimed is:

1. A developing apparatus, comprising:

a developer carrying member configured to carry a developer;

a developer container configured to rotatably support the developer carrying member and to contain the developer; and a regulating member provided on the developer container and configured to regulate a thickness of the developer carried on the developer carrying member, wherein the regulating member comprises:

a support member configured such that, one end thereof is fixed to the developer container and the other end thereof is a free end, the support member being extended in a direction opposite to a rotating direction of the developer carrying member from the one end; and a contact member configured to be fixed to the other end of the support member and contact a surface of the developer carrying member, the contact member comprises:

a contact curved surface that is provided approximately along a peripheral surface of the developer carrying member and that is contactable to the surface of the developer carrying member; and an opposite surface configured to be opposite to the surface of the developer carrying member on an upstream side of the contact curved surface in the rotating direction of the developer carrying member, the opposite surface not in contact with the surface of the developer carrying member, wherein, when the developer carrying member is viewed in a rotation axis direction thereof, a relationship between a radius Rb of an arc formed by at least a part of the contact curved surface and a radius Rd of the surface of the developer carrying member is satisfied with $$Rb>Rd, \text{ and}$$

a center Pb of a virtual circle, along which the contact curved surface extends, exists in regions (i), (ii) and (iii) defined below:

Region (i), which is a region including a virtual straight line Ltp and an area located at an upstream side of the virtual straight line Ltp in the rotating direction of the developer carrying member, and the virtual straight line Ltp passes through a center Pd of the developer carrying member and a point Te;

Region (ii), which is a region including a virtual circle Cp and an area outside the virtual circle Cp, and the virtual circle Cp is such a circle that (1) a center thereof is the point Te and (2) a radius thereof is the radius Rb; and Region (iii), which is a region including such a virtual straight line that (1) passes through the center Pd and (2) forms an angle with the virtual straight line Ltp, and the angle falls in 0 degree and 45 degree, wherein the point Te is a point located at a most upstream position of the contact curved surface in the rotating direction of the developer carrying member.

2. The developing apparatus according to claim 1, wherein, in a cross-section viewed in a rotation axis direction of the developer carrying member, a virtual superimposed amount of pressure when the developer carrying member in a non-load state is virtually superimposed on the regulating member in a non-load state decreases as the location on the developer carrying member approaches a downstream side in the rotating direction of the developer carrying member.

3. The developing apparatus according to claim 1, wherein, when the developer carrying member is viewed in the rotation axis direction, a height of the contact member from the support member is set so that a height from a surface of the support member to the contact curved surface is greater than a height of the opposite surface from the surface of the support member, and the height of the contact curved surface becomes greater as the location on the developer carrying member approaches a downstream side in the rotating direction of the developer carrying member.

4. The developing apparatus according to claim 1, wherein in the rotation direction, a maximum of the contact pressure appears at an upstream side of a region where the contact curved surface and the developer carrying member contact each other.

5. The developing apparatus according to claim 1, wherein, when the developer carrying member is viewed in the rotation axis direction, the contact curved surface overlaps with a virtual circle of which a center is the center Pb and of which a radius is the radius Rb.

6. The developing apparatus according to claim 1, wherein, when the developer carrying member is viewed in the rotation axis direction, the contact member has an arc surface, of which a radius is at least 0.05 mm, between the contact curved surface and the opposite surface.

7. The developing apparatus according to claim 1, wherein, when the developer carrying member is viewed in the rotation axis direction, a length of a virtual straight line connecting two ends of a region where the developer carrying member contacts the contact curved surface is 1.0 mm or more.

8. The developing apparatus according to claim 1, wherein the developer contained in the developer container is a non-magnetic mono-component developer.

9. The developing apparatus according to claim 1, wherein the support member is an elastic member, which has an elasticity higher than an elasticity of a frame member of the developer container.

10. The developing apparatus according to claim 1, wherein the contact member is a flexible member, which has a flexibility higher than a flexibility of the support member.

11. A process cartridge removably attached to a main body of an image forming apparatus, comprising:

an image bearing member for forming an electrostatic latent image thereon; and the developing apparatus according to claim 1, wherein the developing apparatus develops the electrostatic latent image borne on the image bearing member.

12. An image forming apparatus, comprising:

an image bearing member for forming an electrostatic latent image thereon; and the developing apparatus according to claim 1, wherein the developing apparatus develops the electrostatic latent image borne on the image bearing member.

* * * * *